US008480971B2

(12) United States Patent
Kawazoe et al.

(10) Patent No.: US 8,480,971 B2
(45) **Date of Patent: *Jul. 9, 2013**

(54) ANALYTICAL PRETREATMENT DEVICE

(75) Inventors: Hiroshi Kawazoe, Tsukuba (JP); Kunihiko Akai, Chikusei (JP); Kiyoshi Yasue, Tokyo (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/087,878

(22) Filed: Apr. 15, 2011

(65) Prior Publication Data

US 2011/0206558 A1 Aug. 25, 2011

Related U.S. Application Data

(62) Division of application No. 11/791,835, filed as application No. PCT/JP2005/022002 on Nov. 30, 2005.

(30) Foreign Application Priority Data

Nov. 30, 2004 (JP) ..... 2004-346020
Jun. 28, 2005 (JP) ..... 2005-188193

(51) Int. Cl.
*B01L 3/00* (2006.01)

(52) U.S. Cl.
USPC ..... 422/500; 422/50; 422/70; 204/601; 204/602; 210/601; 210/602

(58) Field of Classification Search
USPC ..... 204/601, 602; 210/656, 660; 422/50, 422/70
See application file for complete search history.

(56) References Cited

U.S. PATENT DOCUMENTS

| | | | |
|---|---|---|---|
| 3,674,602 | A | 7/1972 | Keogh et al. |
| 3,702,658 | A | 11/1972 | McNamara et al. |
| 3,915,652 | A | 10/1975 | Natelson |
| 4,693,778 | A | 9/1987 | Swiggett et al. |
| 4,959,152 | A | 9/1990 | Nichols |
| 4,970,034 | A | 11/1990 | Ly et al. |
| 5,070,606 | A | 12/1991 | Hoopman et al. |
| 5,174,900 | A | 12/1992 | Nichols et al. |

(Continued)

FOREIGN PATENT DOCUMENTS

| | | | |
|---|---|---|---|
| DE | 4308697 | A1 | 9/1994 |
| EP | 0521495 | A2 | 1/1993 |

(Continued)

OTHER PUBLICATIONS

Japanese Office Action dated Jul. 26, 2011 (dispatch date), issued in corresponding Japanese Patent Application No. 2009-223292.

(Continued)

*Primary Examiner* — In Suk Bullock
*Assistant Examiner* — Robert Eom
(74) *Attorney, Agent, or Firm* — Westerman, Hattori, Daniels & Adrian, LLP

(57) ABSTRACT

The present invention relates to an analytical pretreatment device, comprising a supporting material 1, m inlet ports 3 as fluid injection ports, n outlet ports 4 as fluid outlet port, m×n hollow filament 5 communicating between the inlet ports and the outlet ports, and n filler cartridges 6 connected to the outlet ports (wherein, m is a natural number; and n is a natural number) that provides an analytical pretreatment device allowing easier automation of the analytical pretreatment step for improvement in operational accuracy and saving in labor.

31 Claims, 4 Drawing Sheets

U.S. PATENT DOCUMENTS

| | | | |
|---|---|---|---|
| 5,236,665 | A | 8/1993 | Mathewson et al. |
| 5,429,807 | A | 7/1995 | Matson et al. |
| 5,534,328 | A | 7/1996 | Ashmead et al. |
| 5,540,464 | A | 7/1996 | Picha |
| 5,591,139 | A | 1/1997 | Lin et al. |
| 5,628,425 | A | 5/1997 | Sharp |
| 5,690,763 | A | 11/1997 | Ashmead et al. |
| 5,779,897 | A | 7/1998 | Kalthod et al. |
| 5,798,143 | A | 8/1998 | Partridge |
| 5,799,817 | A | 9/1998 | Sharp |
| 5,843,767 | A | 12/1998 | Beattie |
| 5,855,801 | A | 1/1999 | Lin et al. |
| 6,063,589 | A | 5/2000 | Kellogg et al. |
| 6,148,508 | A | 11/2000 | Wolk |
| 6,153,101 | A | 11/2000 | Schafer et al. |
| 6,290,791 | B1 | 9/2001 | Shaw et al. |
| 6,344,229 | B2 | 2/2002 | Schubert et al. |
| 6,387,234 | B1 | 5/2002 | Yeung et al. |
| 6,428,678 | B1 | 8/2002 | Rennebeck |
| 6,436,292 | B1 | 8/2002 | Petro |
| 6,463,312 | B1 | 10/2002 | Bergveld et al. |
| 6,592,559 | B1 | 7/2003 | Pakter et al. |
| 6,713,309 | B1 | 3/2004 | Anderson et al. |
| 6,770,246 | B1 | 8/2004 | Husek |
| 6,837,988 | B2 | 1/2005 | Leong et al. |
| 6,846,635 | B1 | 1/2005 | Anderson et al. |
| 6,887,701 | B2 | 5/2005 | Anderson et al. |
| 7,048,723 | B1 | 5/2006 | Frazier et al. |
| 7,122,378 | B1 | 10/2006 | Akita et al. |
| 7,195,699 | B2 | 3/2007 | Kawazoe et al. |
| 7,229,538 | B2 | 6/2007 | Tseng et al. |
| 7,818,077 | B2 | 10/2010 | Bailey |
| 2002/0015952 | A1 | 2/2002 | Anderson et al. |
| 2002/0106468 | A1 | 8/2002 | Obeshaw |
| 2002/0185384 | A1 | 12/2002 | Leong et al. |
| 2003/0034295 | A1 | 2/2003 | Strano et al. |
| 2004/0050705 | A1 | 3/2004 | Tseung et al. |
| 2005/0148091 | A1 | 7/2005 | Kitaguchi et al. |
| 2005/0249367 | A1 | 11/2005 | Bailey |
| 2007/0183933 | A1 | 8/2007 | Kawazoe et al. |
| 2008/0124242 | A1 | 5/2008 | Kawazoe et al. |
| 2009/0269245 | A1 | 10/2009 | Kawazoe et al. |
| 2009/0274581 | A1 | 11/2009 | Kawazoe et al. |
| 2009/0274582 | A1 | 11/2009 | Kawazoe et al. |
| 2009/0274583 | A1 | 11/2009 | Kawazoe et al. |
| 2009/0274584 | A1 | 11/2009 | Kawazoe et al. |
| 2009/0274585 | A1 | 11/2009 | Kawazoe et al. |
| 2009/0274586 | A1 | 11/2009 | Kawazoe et al. |
| 2009/0291264 | A1 | 11/2009 | Akai et al. |
| 2011/0036479 | A1 | 2/2011 | Kawazoe et al. |

FOREIGN PATENT DOCUMENTS

| | | | |
|---|---|---|---|
| EP | 0 725 272 | A1 | 8/1996 |
| EP | 1486455 | A1 | 12/2004 |
| FR | 2813073 | A1 | 2/2002 |
| GB | 2306643 | A | 5/1997 |
| JP | 50-9346 | A | 4/1975 |
| JP | 62-280367 | A | 12/1987 |
| JP | 4-302230 | A | 10/1992 |
| JP | 06-082190 | A | 3/1994 |
| JP | 7-95622 | A | 10/1995 |
| JP | 08-508197 | A | 9/1996 |
| JP | 11-156184 | A | 6/1999 |
| JP | 11-211694 | A | 6/1999 |
| JP | 2000-015065 | A | 1/2000 |
| JP | 2000-019145 | A | 1/2000 |
| JP | 2000-081406 | A | 3/2000 |
| JP | 2000-0246092 | A | 9/2000 |
| JP | 2000-279827 | A | 10/2000 |
| JP | 2001-059910 | A | 3/2001 |
| JP | 2001-505980 | A | 5/2001 |
| JP | 2001-512031 | A | 8/2001 |
| JP | 2001-248072 | A | 9/2001 |
| JP | 2001-264293 | A | 9/2001 |
| JP | 2002-503501 | A | 2/2002 |
| JP | 2002-505515 | A | 2/2002 |
| JP | 2002-292274 | A | 10/2002 |
| JP | 2003-138058 | A | 5/2003 |
| JP | 2004-174701 | A | 6/2004 |
| JP | 2005-504255 | A | 2/2005 |
| JP | 2005-103750 | A | 4/2005 |
| JP | 2005-326068 | A | 11/2005 |
| KR | 10-2004-0089663 | A | 10/2004 |
| TW | 536524 | B | 6/2003 |
| WO | 94/21372 | A1 | 9/1994 |
| WO | 98/00231 | A1 | 1/1998 |
| WO | 98/25065 | A1 | 6/1998 |
| WO | 98/53046 | A1 | 11/1998 |
| WO | 99/06589 | A1 | 2/1999 |
| WO | 99/41606 | A1 | 8/1999 |
| WO | 00/16833 | A1 | 3/2000 |
| WO | 01/08802 | A1 | 2/2001 |
| WO | 01/09607 | A1 | 2/2001 |
| WO | 01/77683 | A1 | 10/2001 |
| WO | 03/026875 | A1 | 4/2003 |
| WO | 03/070623 | A1 | 8/2003 |
| WO | 2004/009231 | A1 | 1/2004 |

OTHER PUBLICATIONS

Japanese Office Action dated Jul. 26, 2011 (dispatch date), issued in corresponding Japanese Patent Application No. 2010-021870.

Japanese Office Action dated Jul. 26, 2011 (dispatch date), issued in corresponding Japanese Patent Application No. 2010-021873.

Japanese Office Action dated Jul. 26, 2011 (dispatch date), issued in corresponding Japanese Patent Application No. 2010-021876.

Ryutaro Maeda, "R&D Trends of Microfluidic Device Packaging Technologies (R&D Trend of Packaging for Micro Fluidic Systems)", Journal of Japan Institute of Electronics Packaging, vol. 5, No. 1, pp. 25-27, Jan. 2002.

Shoji, "Flow Control in Microchannels"; Chemical Industry, 52, 4, pp. 42-46, Nov. 2001.

Summons to Attend Oral Proceedings dated Apr. 9, 2010, issued in European Patent Application No. 08000280.1.

Summons to Attend Oral Proceedings dated Apr. 9, 2010, issued in related European Patent Application No. 08000281.9.

Summons to Attend Oral Proceedings dated Apr. 9, 2010, issued in related European Patent Application No. 08000282.7.

Summons to Attend Oral Proceedings dated Apr. 9, 2010, issued in related European Patent Application No. 08000283.5.

Summons to Attend Oral Proceedings dated Apr. 9, 2010, issued in related European Patent Application No. 08000284.3.

Summons to Attend Oral Proceedings dated Apr. 9, 2010, issued in related European Patent Application No. 08000285.0.

Tobias Merkel et al., "A new technology for fluidic microsystems based on PCB technology"; Sensors and Actuators, vol. 77, issue Oct. 2, 1999, pp. 98-105.

Taiwanese Office Action dated Oct. 23, 2007, issued in Taiwanese Application No. 094104795.

Japanese Office Action dated Oct. 5, 2010 (mailing date), issued in related Japanese Patent Application No. 2006-546773.

Chinese Office Action dated Apr. 14, 2010, issued in corresponding Chinese Patent Application No. 2008-101499257.

Chinese Office Action dated Nov. 2, 2010, issued in corresponding Chinese Patent Application No. 2008-101499257.

Chinese Office Action dated Oct. 27, 2010, issued in corresponding Chinese Patent Application No. 2005-80042277.

U.S. Office Action dated Nov. 26, 2008, issued in related U.S. Appl. No. 10/505,416.

U.S. Office Action dated Jun. 24, 2009, issued in related U.S. Appl. No. 10/505,416.

U.S. Office Action dated Dec. 3, 2009, issued in related U.S. Appl. No. 12/496,212.

U.S. Office Action dated May 28, 2010, issued in related U.S. Appl. No. 12/496,212.

U.S. Office Action dated Oct. 22, 2009, issued in related U.S. Appl. No. 12/501,056.

U.S. Office Action dated May 18, 2010, issued in related U.S. Appl. No. 12/501,056.

U.S. Office Action dated May 19, 2010, issued in related U.S. Appl. No. 12/501,078.

U.S. Office Action dated Oct. 22, 2009, issued in related U.S. Appl. No. 12/501,078.
U.S. Office Action dated Oct. 22, 2009, issued in related U.S. Appl. No. 12/501,097.
U.S. Office Action dated May 19, 2010, issued in related U.S. Appl. No. 12/501,097.
U.S. Office Action dated Nov. 25, 2009, issued in related U.S. Appl. No. 12/501,108.
U.S. Office Action dated Jun. 4, 2010, issued in related U.S. Appl. No. 12/501,108.
U.S. Office Action dated Nov. 24, 2009, issued in related U.S. Appl. No. 12/501,120.
U.S. Office Action dated Jun. 1, 2010, issued in related U.S. Appl. No. 12/501,120.
U.S. Office Action dated Mar. 17, 2010, issued in related U.S. Appl. No. 12/502,394.
U.S. Office Action dated Aug. 23, 2010, issued in related U.S. Appl. No. 12/502,394.
U.S. Office Action dated Jan. 26, 2009, issued in related U.S. Appl. No. 10/598,086.
U.S. Office Action dated Feb. 4, 2010, issued in related U.S. Appl. No. 10/598,086.
U.S. Office Action dated Feb. 25, 2009, issued in related U.S. Appl. No. 11/791,835.
U.S. Office Action dated Oct. 15, 2009, issued in related U.S. Appl. No. 11/791,835.
U.S. Office Action dated May 12, 2010, issued in related U.S. Appl. No. 11/791,835.
U.S. Office Action dated Jul. 22, 2010, issued in related U.S. Appl. No. 11/721,361.
Chinese Office Action dated Oct. 17, 2008, issued in related Chinese Patent Application No. 200580042277X.
Chinese Office Action dated Jun. 1, 2010, issued in related Chinese Patent Application No. 2008101499261.
European Search Report dated Apr. 9, 2010, issued in counterpart European Application No. 08000283.5.
European Search Report dated Feb. 19, 2007, issued in counterpart European Application No. 03707062.0.
European Search Report dated Mar. 5, 2008, issued in corresponding European Patent Application No. 08000280.1.
European Search Report mailed Mar. 2, 2007, issued in corresponding European Patent Application No. 05719235.3.
ISR of PCT/JP2005/002433, date of mailing Jul. 12, 2005.
ISR of PCT/JP2005/022002, date of mailing Mar. 7, 2006.
ISR of PCT/JP2005/022656, date of mailing Mar. 7, 2006.
Japanese Office Action dated Oct. 17, 2006, issued in Japanese Patent Application No. 2003-046414.
Japanese Office Action dated Aug. 4, 2009, issued in related Japanese Patent Application No. 2006-254995.
Japanese Office Action dated Jul. 28, 2009, issued in related Japanese Patent Application No. 2006-510632.
Japanese Office Action dated Oct. 27, 2009, issued in related Japanese Patent Application No. 2006-510632.
Japanese Office Action dated Jan. 5, 2010, issued in related Japanese Patent Application No. 2006-547983.
Japanese Office Action dated Mar. 2, 2010, issued in related Japanese Patent Application No. 2006-254995.
Japanese Office Action dated Mar. 16, 2010, issued in related Japanese Patent Application No. 2006-230767.
Korenaga, "Indoor/Outdoor Air Pollution and Its Monitoring", 14th National Congress for Environmental Studies, Science Council of Japan, pp. 25-32, 1999 (with English abstract).
Japanese Office Action dated Mar. 16, 2010, issued in related Japanese Patent Application No. 2009-230778.
Japanese Office Action dated Jun. 29, 2010, issued in related Japanese Patent Application No. 2007-299538.
Japanese Office Action dated Jun. 29, 2010, issued in related Japanese Patent Application No. 2006-254995.
Korean Office Action dated Mar. 20, 2006, issued in related Korean Patent Application No. 10-2004-7013114.
Korean Office Action dated Oct. 2, 2006, issued in related Korean Patent Application No. 10-2004-7013114.
Korean Office Action dated Oct. 2, 2006, issued in related Korean Patent Application No. 10-2006-7016790.
Korean Office Action dated Oct. 2, 2006, issued in related Korean Patent Application No. 10-2006-7016791.
Korean Office Action dated Nov. 26, 2008, issued in related Korean Patent Application No. 10-2007-7013071.
Korean Office Action dated Aug. 13, 2010, issued in related Korean Patent Application No. 10-2009-7025349.
U.S. Non-Final Office Action dated Jun. 13, 2011, issued in U.S. Appl. No. 12/496,212.
U.S. Non-Final Office Action dated Mar. 29, 2011, issued in U.S. Appl. No. 13/026,811.
U.S. Non-Final Office Action dated Jun. 24, 2010, issued in U.S. Appl. No. 10/598,086.
U.S. Final Office Action dated Apr. 18, 2011, issued in U.S. Appl. No. 10/598,086.
U.S. Final Office Action dated Nov. 26, 2010, issued in U.S. Appl. No. 11/791,835.
U.S. Non-Final Office Action dated Mar. 29, 2011, issued in U.S. Appl. No. 13/026,889.
U.S. Non-Final Office Action dated Apr. 15, 2011, issued in U.S. Appl. No. 13/026,875.
U.S. Final Office Action dated Aug. 18, 2011, issued in U.S. Appl. No. 13/026,875.
U.S. Non-Final Office Action dated Jul. 8, 2011, issued in U.S. Appl. No. 12/501,078.
U.S. Final Office Action dated Jul. 15, 2011, issued in U.S. Appl. No. 12/501,108.
U.S. Final Office Action dated Jul. 19, 2011 issued in U.S. Appl. No. 12/501,120.
U.S. Final Office Action dated Nov. 12, 2010, issued in U.S. Appl. No. 11/721,361.
U.S. Non-Final Office Action dated Jul. 12, 2011 issued in U.S. Appl. No. 12/914,010.
Japanese Office Action dated Jul. 26, 2011 (mailing date), issued in Japanese Patent Application No. 2009-230797 with an English language translation.
Chinese Office Action dated Aug. 3, 2012 issued in Chinese patent application No. 200810149922.3, with English translation (5 pages).
Ukai et al., Machine Translation of JP2001-264293. Publication Year: 2001. 10 pages. cited in U.S. Office Action dated Mar. 6, 2012, issued in corresponding U.S. Appl. No. 12/496,212.
U.S. Office Action dated Mar. 8, 2012, issued in corresponding U.S. Appl. No. 12/501,056.
U.S. Office Action dated Mar. 8, 2012, issued in corresponding U.S. Appl. No. 12/501,078.
U.S. Office Action dated Mar. 27, 2012, issued in corresponding U.S. Appl. No. 12/501,120.
U.S. Office Action dated Mar. 27, 2012, issued in corresponding U.S. Appl. No. 12/501,108.
Chinese Office Action dated Feb. 16, 2012, issued in corresponding Chinese Patent Application No., 201010574369.5, (w/Partial translation, 4 pages).
Japanese Office Action dated Jun. 12, 2012, issued in related Japanese Patent Application No. 2010-271950 (9 pages) with an English language translation.
U. S. Non-Final Office Action dated Sep. 14, 2012, issued in U.S. Appl. No. 12/914,010.
U. S. Final Office Action dated Jul. 11, 2012, issued in U.S. Appl. No. 12/501,120.
Chinese Office Action dated Dec. 9, 2011, issued in corresponding Application No. 2006101427349, with English Translation.
Chinese Office Action dated Dec. 8, 2011, issued in corresponding Application No. 2006101427334, with English Translation.
U.S. Office Action dated Mar. 6, 2012, issued in corresponding U.S. Appl. No. 12/496,212.
U.S. Office Action dated Feb. 17, 2012, issued in corresponding U.S. Appl. No. 13/026,811.
Chinese Office Action dated Dec. 16, 2011, issued in corresponding Application No. 2008101499223, with English Translation.
U.S. Office Action dated Dec. 29, 2011, issued in corresponding U.S. Appl. No. 11/791,835.

U.S. Final Office Action dated Nov. 2, 2012, issued in U.S. Appl. No. 12/501,108.
Chinese Office Action dated Sep. 28, 2012, issued in Chinese Patent Application No. 201010574369.5, w/ English Translation).
U.S. Final Office Action dated Nov. 26, 2012, issued in U.S. Appl. No. 11/791,835.
Extended European Search Report (EESR) dated Jan. 2, 2013, issued in corresponding European Patent Application No. 05811638.5 (6 pages).
U.S. Final Office Action dated Feb. 7, 2013, issued in U.S. Appl. No. 12/914,010.

ANALYTICAL PRETREATMENT DEVICE

This application is a divisional application of U.S. Non-Provisional application Ser. No. 11/791,835, filed May 30, 2007, which is a National Stage of International Application No. PCT/JP2005/022002, filed Nov. 30, 2005, which is hereby incorporated by reference.

TECHNICAL FIELD

The present invention relates to a device favorably used in pretreatment of an analytical sample for example in chemical analysis.

BACKGROUND ART

Chemical analysis processes commonly practiced currently are roughly divided into four steps: (1) sampling, (2) pretreatment, (3) analysis and measurement, and (4) data processing. For example, environmental analysis of river water and wastewater from plant and biochemical analysis such as clinical test often demand analysis of a trace amount of substance, and thus demand a concentration step essentially for pretreatment. However, the operation demands a vast amount of labor and period. Recently developed was a new concentration method of making only an analyte substance in sample adsorbed on a special filler, washing the filler in a fluid, and extracting the analyte substance in sample at a higher concentration by extraction with an eluant. Although the method simplifies the concentration operation described above, the operation should be repeated if there are many kinds of analyte substances in the sample.

Analytical pretreatment is aimed at previously treating a sample or the analyte substance therein properly to make the trace analysis and measurement performed accurately and rapidly. The main purposes are prevention of change of desired substances over time, improvement in accuracy and sensitivity, removal of measurement-disturbing substances, protection or prevention of deterioration of the column and analytical instrument, simplification of analysis and measurement operation, and others. It is not possible to obtain accurate analytical results without proper pretreatment.

Unit operations in the analytical pretreatment include a) weighing, b) extraction, c) cleaning, d) filtration, e) dehydration/demineralization, f) concentration/dilution, g) derivatization, and h) addition of standard substance. These operations were mostly performed manually, and the chemistry devices and tools used were not common in the unit operations and each operation should be carried out by a different operator. The operational accuracy, which depends largely on the skill of the operator, varies significantly, and such an operation demanded a large amount of labor.

On the other hand in the fields of biochemical and environmental analysis, under progress is a research for miniaturization and automation of analytical instrument by using MEMS (micro-electro-mechanical system) technology. Single-function mechanical components (micromachines) , components of analyzer, such as micropump and micro valve have been studied (see, for example, Shoji, "Chemical Industry", Kagaku Kogyo, November 2001, 52, 11, p. 42-46, and Maeda, "Journal of Japan Institute of Electronics Packaging", Japan Institute of Electronics Packaging, January 2002, 5, 1, p. 25-26).

It is necessary to put together various multiple parts such as micromachines into a system for desirable chemical analysis. Generally, such a system thus integrated is called a micro total analysis system (μTAS). Normally, such a micromachine is formed on, for example, a silicon chip by application of semiconductor manufacturing process, or on a plastic material such as acrylic or silicone resin. It is in principle possible to integrate multiple components on one chip (integration) into a system, and such studies were also made (see, for example, Korenaga, "50th National Congress for Environmental Studies, Science Council of Japan", 1999, 14, p. 25-32). However, the production process is complicated, and it would be difficult to produce such a system at the mass production level. In contrast, International Publication WO 03/070623 discloses a method of using a hollow filament as channel as it is placed at a particular position. The method allows crosswise installation of channels and production of a device having a number of channels relatively easily.

SUMMARY OF THE INVENTION

However currently, the application of MEMS technology described above is only limited to analysis and measurement, and application thereof to analytical pretreatment process for improvement in operational accuracy or saving in labor was difficult. An object of the present invention is to provide an analytical pretreatment device allowing easier automation of the analytical pretreatment step for improvement in operational accuracy and saving in labor.

The present invention relates to (1) an analytical pretreatment device, comprising a supporting material, m inlet ports as fluid injection ports, n outlet ports as fluid outlet port, m×n hollow filament communicating between the inlet ports and the outlet ports, and n filler cartridges connected to the outlet ports (wherein, m is a natural number; and n is a natural number). The pretreatment device employing hollow filaments as its channels is superior in accuracy. In addition, use of hollow filaments is effective in preventing adverse effects on analytical results, for example, by undesirable leakage of fluid.

The present invention also relates to (2) the analytical pretreatment device according to (1), wherein at least part of the inlet ports are connected to the supporting material. The analytical pretreatment device is more rigid structurally and can be used in applications under stricter environment.

The present invention also relates to (3) the analytical pretreatment device according to (1) or (2), wherein at least part of the outlet ports are connected to the supporting material. The analytical pretreatment device is more rigid structurally and can be used in applications under stricter environment.

The present invention also relates to (4) the analytical pretreatment device according to any one of (1) to (3), wherein at least part of the hollow filaments are connected to the supporting material. The analytical pretreatment device is more rigid structurally and can be used in applications under stricter environment.

The present invention also relates to (5) the analytical pretreatment device according to any one of (1) to (4), wherein the outlet port and the filler cartridge are integrated. The analytical pretreatment device has a smaller number of parts and thus, would be lower in production cost.

The present invention also relates to (6) the analytical pretreatment device according to any one of (1) to (5), wherein there are two or more inlet ports. It is possible to perform pretreatment easily in the analytical pretreatment device, by supplying suitable fluids consecutively from respective inlet ports even when there are multiple kinds of fluids needed for pretreatment.

The present invention also relates to (7) the analytical pretreatment device according to any one of (1) to (5), wherein there are two or more outlet ports. It is possible to perform pretreatment easily on a single analytical pretreatment device, even when multiple analyte substances are contained in one sample. The device is also higher in efficiency, because it is possible to perform pretreatment at a time even when a single analyte substance is analyzed.

The present invention also relates to (8) the analytical pretreatment device according to any one of (1) to (5), wherein there are two or more inlet ports and two or more outlet ports. It is possible to perform pretreatment easily on a single analytical pretreatment device, even when multiple kinds of fluids are needed for pretreatment and multiple analyte substances are contained in one sample.

The present invention also relates to (9) the analytical pretreatment device according to any one of (6) to (8), wherein at least one hollow filament is placed is such a manner that it crosses at least one other hollow filament. Thus, it is possible to provide an analytical pretreatment device having an unlimited number of analytical pretreatment steps. Such a pretreatment device is easier to design, because there are fewer restrictions on installing hollow filaments.

The present invention also relates to (10) the analytical pretreatment device according to any one of (1) to (9), wherein the supporting material has a fixing layer for holding the hollow filaments. Thus, the hollow filaments are held easily.

The analytical pretreatment device according to the present invention allows easier automation of the analytical pretreatment step, leading to reduction in the fluctuation in accuracy among operators and improvement in operational accuracy. It also allows saving in labor. In addition, it is possible to form long-distance channels in the order of cm to m, depending on specification, and thus, the analytical pretreatment device is easily applicable to large-scale analytical and measuring instruments. It can also cope with reduction in size of analytical and measuring instruments by reduction in diameter of the hollow filament.

This application claims priority from Japanese Patent Application No. 2004-346020 filed on Nov. 30, 2004 and Japanese Patent Application No. 2005-188193 filed on Jun. 28, 2005, the disclosure of which is incorporated by reference herein.

EXPLANATION OF REFERENCE NUMERALS

1: supporting material

1*a*: First supporting material

1*b*: Second supporting material

2. Fixing layer

3. Four inlet ports

Figure 1:
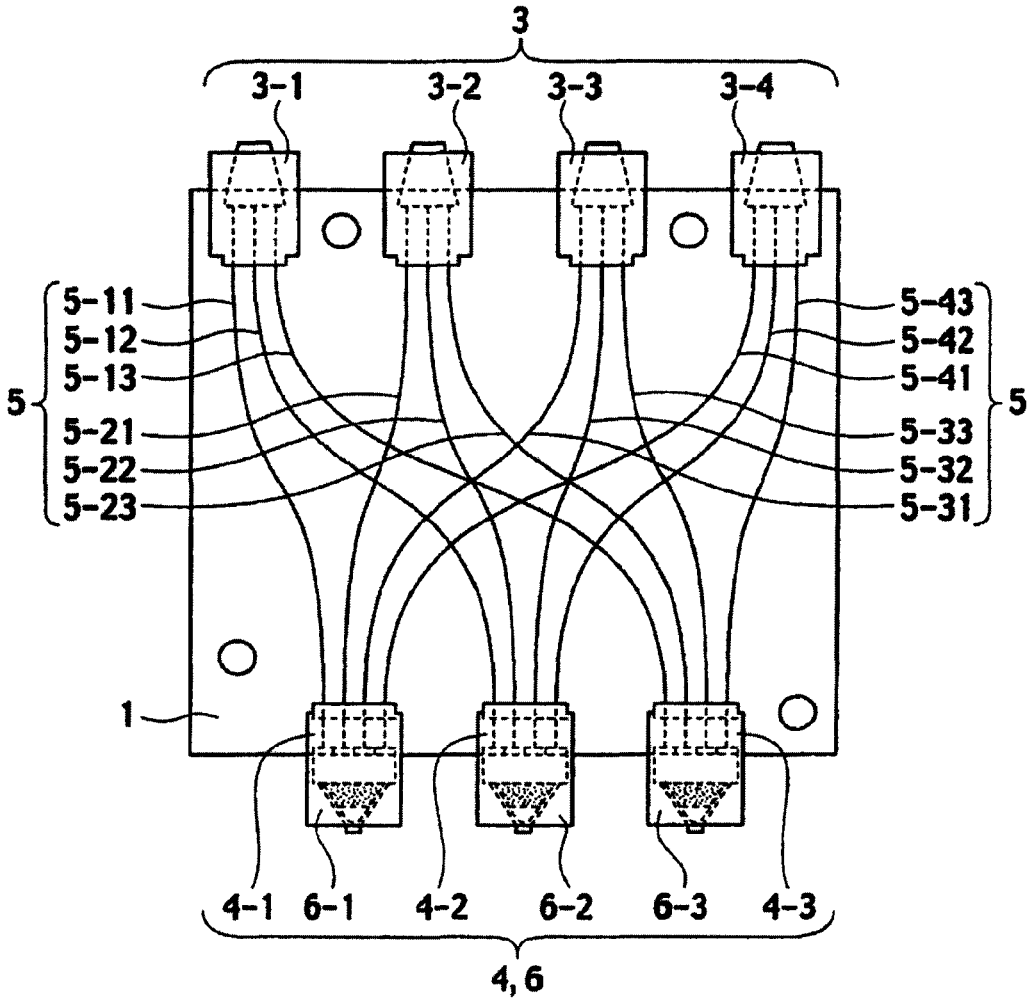
FIG. 1 is a schematic top view illustrating the analytical pretreatment device in an embodiment of the present invention.

3-1, 3-2, 303, and 3-4: I-th inlet ports (i is a natural number of $1 \leqq i \leqq 4$)

4: Three outlet port

5: 4×3 Hollow filaments communicating between inlet and outlet ports

5-11, 5-12, 5-13, 5-21, 5-22, 5-23, 5-31, 5-32, 5-33, 5-42, and 5-43: Hollow filament communicating between the i-th inlet port and the j-th outlet port among 4×3 filaments (I is a natural number of $1 \leqq i \leqq 4$, and j is a natural number of $1 \leqq j \leqq 3$)

6: Three filler cartridges connected to outlet ports

6-1, 6-2, and 6-3: J-th filler cartridge (j is a natural number of $1 \leqq j \leqq 3$)

DETAILED DESCRIPTION OF THE INVENTION

An embodiment according to the present invention will be described with reference to drawings. In the following drawings, the same or similar region is indicated with the same or similar code number. However, the drawings show only a typical embodiment, and the relationship between thickness and planar dimension, the ratio in thickness of respective layers, the shape of formed pattern, and others may be different from those of the actual product. Accordingly, specific thickness, dimension and shape of the formed pattern shape should be determined with reference to the following description. It should be noted that there are some regions where the dimensional relationship and the ratio are different from each other in the drawings below.

An embodiment according to the present invention will be described in detail with reference to the analytical pretreatment devices shown in FIGS. 1 to 4. FIG. 1 is a schematic top view of the analytical pretreatment device in the embodiment of the present invention.

As shown in FIG. 1, the analytical pretreatment device according to the present invention has a supporting material 1, m inlet ports 3 for injecting fluid (four inlet ports 3-1 to 3-4 in FIG. 1), n outlet ports 4 for discharging fluid (three outlet ports 4-1 to 4-3 in FIG. 1), m×n hollow filaments 5 communicating between the inlet ports and the outlet ports (12 filaments 5-11 to 5-43 in FIG. 1), and n filler cartridges 6 connected to the outlet ports 4 (three cartridges 6-1 to 6-3 in FIG. 1), wherein, m is a natural number; and n is a natural number.

Among the m inlet ports, the i-th inlet port 3-i will be designated as inlet port Ai;

among the n outlet ports, the j-th outlet port 4-j will be designated as outlet port Bj, among the m×n filaments, the hollow filament 5-ij communicating between the i-th inlet port and the j-th outlet port will be designated as hollow filament Xij, and among n filler cartridges, the j-th filler cartridge 6-j will be called filler cartridge Cj.

wherein, m is a natural number, i is a natural number of $1 \leqq i \leqq m$; n is a natural number; and j is a natural number of $1 \leqq j \leqq n$).

FIG. 1 shows an analytical pretreatment device in which three kinds of analyte substances are containing in one sample, and four kinds of fluids, (1) a solvent for wetting the filler (buffer solution), (2) a sample solution, (3) washing water, and (4) an elution solution, are needed for pretreatment. Thus in the analytical pretreatment device above, m is 4, and n is 3, and thus, it has inlet ports 3 consisting of four inlet ports Ai (i=1, 2, 3, and 4) 3-1, 3-2, 3-3, 3-4, outlet ports 4 consisting of three outlet ports Bj (j=1, 2, and 3) 4-1, 4-2, and 4-3, filler cartridges 6 consisting of three filler cartridges Cj (j=1, 2, and 3) 6-1, 6-2, and 6-3, and hollow filaments 5 consisting of 12 (3×4) hollow filament Xij communicating between the inlet ports Ai and the outlet ports Bj (i=1, 2, 3, and 4, and j=1, 2, and 3) 5-11, 5-12, 5-13, 5-21, 5-22, 5-23, 5-31, 5-32, 5-33, 5-41, 5-42, and 5-43. In such a case, three kinds of fillers respectively suitable for the analyte substances (not shown in Figure) are packed in the three filler cartridges 6. These inlet ports 3 and the outlet ports 4 are connected to the supporting material 1, and the filler cartridges 6 are connected to the outlet ports 4.

A sample injected into one inlet port Ai flows out of all outlet ports B1 to Bm, for example, according to the connection pattern of the m×n hollow filaments Xij connecting the inlet ports respectively to the outlet ports. The flow pattern is favorable in environmental analysis and clinical analysis.

Then, when a solvent (1) for wetting the filler (buffer solution) is injected from the first inlet port (A1) 3-1, a sample solution (2) from the second inlet port (A2) 3-2, and washing water (3) from the third inlet port (A3) 3-3 respectively at a suitable timing, the corresponding analyte substance is adsorbed separately to the filler cartridge (Cj) 6-j connected to the outlet port (Bj) 4-j and the untargeted substances are removed with washing water. Then, analysis and measurement are performed easily by connecting the filler cartridge (Cj) 6-j to an analytical and measuring instrument (not shown in Figure) and supplying an elution solution (4) from the fourth inlet port (A4) 3-4.

It is also possible to pre-treat the sample at a time, even when the analyte substance is a single substance. Thus, such a system is more efficient, because it allows analysis and measurement multiple times subsequently and also, analysis and measurement of different kinds of analytes.

The number of the inlet ports 3 or the outlet ports 4 is not particularly limited, but preferably two or more. When there are two or more inlet ports, it is possible to perform the pretreatment easily by supplying the fluids consecutively from respective inlet ports even when there are multiple fluids needed for pretreatment. When there are two or more outlet ports, it is possible to operate easily in an analytical pretreatment device, even when there are multiple analyte substances contained in one sample. The system is higher in efficiency even when the analyte substance is a single substance, because it is possible to perform pretreatment at a time. When there are two or more inlet and outlet ports respectively, it is possible to perform pretreatment easily in the analytical pretreatment device, even when there are multiple fluids needed for pretreatment and multiple analyte substances are contained in a single sample. The upper limit thereof is about 10, preferably about 8, more preferably about 5, from the point of convenience in handling.

Specific examples of the materials for the hollow filament include organic materials such as polyvinyl chloride resin (PVC), polyvinylidene chloride resin, polyvinyl acetate resin, polyvinylalcohol resin (PVA), polystyrene resin (PS), acrylonitrile-butadiene-styrene copolymer (ABS), polyethylene resin (PE), ethylene-vinyl acetate copolymer (EVA), polypropylene resin (PP), poly-4-methylpentene resin (TPX), polymethyl methacrylate resin (PMMA), polyether ether ketone resin (PEEK), polyimide resin (PI), polyether imide resin (PEI), polyphenylene sulfide resin (PPS), cellulose acetate, ethylene tetrafluoride resin (PTFE), propylene tetrafluoride hexafluoride resin (FEP), ethylene tetrafluoride-perfluoroalkoxyethylene copolymer (PFA), ethylene tetrafluoride-ethylene copolymer (ETFE), ethylene trifluoride chloride resin (PCTFE), vinylidene fluoride resin (PVDF), polyethylene terephthalate resin (PET), polyamide resin (nylon, etc.), polyacetal resin (POM), polyphenyleneoxide resin (PPO), polycarbonate resin (PC), polyurethane resin, polyester elastomer, polyolefin resin, and silicone resin; inorganic materials such as glass, quartz, and carbon; and the like.

The internal and external diameters of the hollow filament 5 may be determined properly according to applications. The internal diameter is preferably, approximately 0.01 to 1.0 mm, because the flow rate per unit time is usually in the order of milliliter (mL) to microliter (μL). For example, resin materials such as PI, PEEK, PEI, PPS, and PFA are particularly favorable in preparation of the hollow filament having a diameter in such a range. An internal diameter of less than 0.01 mm may lead to unnegligible increase in the interfacial resistance between the internal wall face of hollow filament and the fluid and consequently, to troubles such as clogging. On the other hand, an internal diameter of more than 1.0 mm demands high pressure for continuous supply of the fluid, leading to increase of the load to other parts and contamination of the fluid for example by air bubbles.

As shown in FIG. 1, at least one hollow filament may be placed in such a manner that it cross at least one other hollow filament. It is thus possible to place the hollow filaments, independently of the positions of the hollow fibers previously installed, and to provide an analytical pretreatment device independent of the number of the hollow filaments, i.e., the number of steps of analytical pretreatment, and also of the sampling number. It also provides freedom in designing the device, because there is no restriction that no hollow filament should be placed in the area close to the hollow filaments previously installed.

Figure 2:
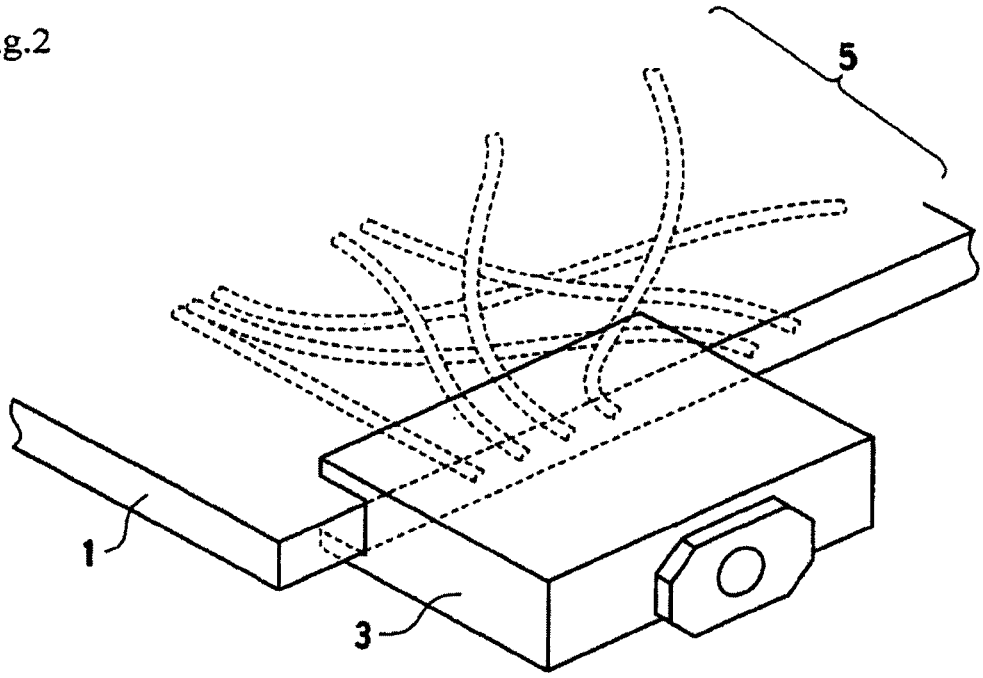
FIG. 2 is a perspective view of an area close to an input port of the analytical pretreatment device in another embodiment of the present invention.

FIG. 2 is a perspective view of the region close to another input port 3 connected to the supporting material 1 of the analytical pretreatment device in an embodiment of the present invention. The hollow filament 5 is more vulnerable to buckling and breakage and restricts fluid flow, when the diameter thereof becomes smaller. In particular when the external diameter of the hollow filament is 1 mm (diameter) or less, it is preferable to connect the input port to part of the supporting material and prevent the hollow filament from unneeded external force.

Even when the device has a structure in which the hollow filaments are exposed on the surface, it is possible to use it with care in handling. In particular for further improvement in handling efficiency, it is preferable to form an additional layer for prevention of exposure of the hollow filaments. The protective layer is formed, for example, by lamination of a film or plate of a material similar to that for the supporting material. Specifically as shown in FIGS. 3 and 4, the hollow filament 5 may be placed between the original supporting material (hereinafter, referred to as "first supporting material") 1*a* and an additional second supporting material 1*b* newly formed.

Figure 3:
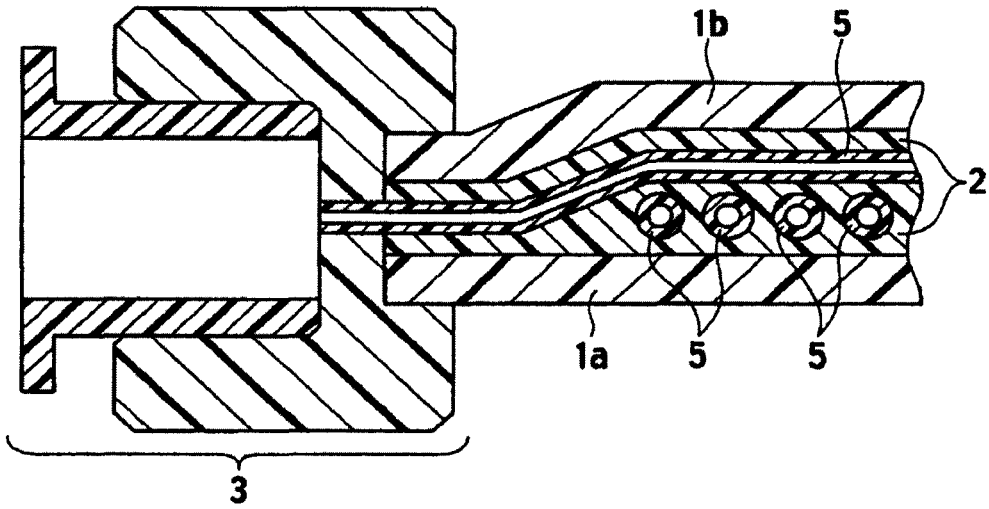
FIG. 3 is schematic cross-sectional view of the area close to an input port of the analytical pretreatment device in an embodiment of the present invention.
Figure 4:
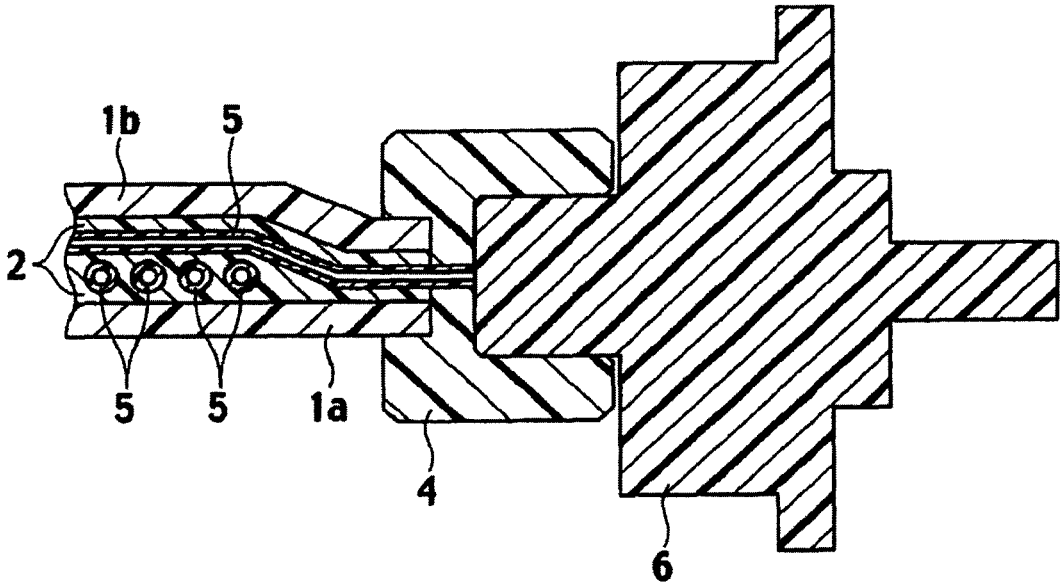
FIG. 4 is schematic cross-sectional view of the area close to an output port and a filler cartridge of the analytical pretreatment device in an embodiment of the present invention.

FIG. 3 is a schematic cross-sectional view illustrating the input port 3 connected to part of the supporting materials 1*a* and 1*b* in the region close to the input port of the analytical pretreatment device. Alternatively, FIG. 4 is a schematic cross-sectional view illustrating the outlet port 4 connected to part of the supporting materials 1*a* and 1*b* in the area close to the output port and filler cartridge of the analytical pretreatment device.

For example, the material, shape, and size of the supporting materials 1*a* and 1*b* vary and thus are determined properly according to the applications and the desirable functions of the device. For example for applications demanding electric insulation, favorable are epoxy resin plates and polyimide resin plates used for printed wiring boards, and polyimide films such as Kapton (registered trade name) film manufactured by E.I. du Pont de Nemours and Company, PET films such as Lumirror (registered trade name) film manufactured by Toray Industries, Inc., and PPS films such as Torelina (registered trade name) film manufactured by the same company used for flexible printed wiring boards.

In applications demanding electric insulation, the thickness of the supporting material (film) is preferably larger and more preferably 0.05 mm or more. The upper limit is approximately 3 mm.

Alternatively, in applications demanding mechanical strength, the thickness of the supporting material (film) is preferably increased or a high-strength material is used, and in applications demanding flexibility, the thickness of the supporting material (film) is preferably lowered or a more flexible material is used. The properties of the device may be altered by installation of a fixing layer described below, instead of changing the material for or the thickness of the supporting material.

Alternatively in applications demanding high heat-releasing efficiency from the supporting material, a metal foil or plate of aluminum (Al), copper (Cu), stainless steel, titanium (Ti), or the like is selected favorably. In such a case, the thickness of the first supporting material la is preferably thicker and more preferably 0.5 mm or more.

Alternatively in applications demanding light transparency from the supporting material, for example, an inorganic plate such as of glass or quartz plate or an organic plate such as of PET, fluoroplastic, polycarbonate, or acrylic is selected favorably. In such a case, the thickness of the first supporting material 1*a* is preferably thinner, more preferably 0.5 mm or less.

Yet alternatively, a so-called flexible circuit board or a printed circuit board having a metal pattern such as of copper formed by etching or plating on the surface may be used as the supporting material. It is thus possible to produce easily terminals and circuits containing various parts and elements including electrical elements such as micromachine, heat generation element, piezoelectric device, various sensors of temperature, pressure, deformation, vibration, voltage, magnetic field, and others, electronic part such as resistor, capacitor, coil, transistor, and IC, and also optical parts including laser diode (LD), light-emitting diode (LED), and photodiode (PD) and others, and also to put together these parts and elements into a system easily.

Various materials for use as the first supporting material 1*a* are also usable for the second supporting material 1*b*. In particular when a network-structured or porous film is used as the second supporting material, it is possible to prevent troubles caused by incorporation of air bubbles during lamination. Examples of the network-structured films or cloths include polyester mesh No. TB-70 manufactured by Tokyo Screen and the like, and examples of the porous films include Duraguard (trade name) manufactured by Celanese, Celgard 2400 (trade name) manufactured by Daicel Chemical Industries, and the like.

As shown in FIGS. 3 and 4, a fixing layer 2 for holding the hollow filaments may be formed on the hollow filament-sided surface of the first supporting material 1*a* and/or the second supporting material 1*b*. It is thus possible to fix the hollow filaments 5 easily. Specifically, a layer of an adhesive, adhesive material, rubber or gel is formed. For example, an adhesive of a synthetic rubber or a silicone resin is favorably used.

Examples of the synthetic rubber adhesives include isobutylene polymers such as Vistanex MML-120 (trade name) manufactured by Tonex, acrylonitrile-butadiene rubbers such as Nipol N1432 (trade name) manufactured by Zeon Corporation, chlorosulfonated polyethylenes such as Hypalon 20 (trade name) manufactured by E.I. du Pont de Nemours and Company, and the like. In addition, a crosslinking agent may be added as needed to these materials. Further, acrylic resin-based adhesive tapes such as the product No. 500 manufactured by Nitto Denko Corporation, VHB products, A-10, A-20, and A-30, manufactured by 3M, and the like are also usable.

The silicone-resin adhesive is preferably a silicone adhesive containing a silicone rubber of high-molecular-weight polydimethylsiloxane or polymethylphenylsiloxane having a silanol group at the terminal and a silicone resin such as methyl silicone resin or methylphenyl silicone as principal components. The resin may be crosslinked for control of the cohesive force, for example, by addition reaction of silane, alkoxycondensation reaction, acetoxycondensation reaction, radical reaction by peroxide, or the like. Commercially available products of the adhesive include YR3286 (trade name, manufactured by GE Toshiba Silicones), TSR1521 (trade name, manufactured by GE Toshiba Silicones) , DKQ9-9009 (trade name, manufactured by Dow Corning), and the like.

Examples of the silicone rubbers include SYLGARD184 (trade name, manufactured by Dow Corning Asia), and examples of the urethane rubbers include Molding Urethane Gel (trade name, manufactured by Exseal Corporation) and the like.

A photosensitive adhesive may be used for the fixing layer 2. For example, a dry film resist used as an etching resist for printed circuit boards, a solder resist ink, or a photosensitive build-up material for printed circuit boards is applicable. Specific examples thereof include H-K440 (trade name) manufactured by Hitachi Chemical Co., Ltd., Probimer (trade name) manufactured by Ciba-Geigy Corp., and the like. In particular, photobia materials available for build-up wiring board application withstand the production process of printed wiring board and the component-mounting step by soldering. Any composition may be used as such a material, if it is a composition containing a copolymer or monomer having a photocrosslinkable functional group and/or a composition containing a photo- and thermo-crosslinkable functional group and a thermal polymerization initiator. Examples thereof include alicyclic epoxy resins such as epoxy resins, brominated epoxy resins, rubber-modified epoxy resins, and rubber-dispersed epoxy resins; bisphenol-A-based epoxy resins, the acid-modified products of the epoxy resins, and the like. In particular, for photohardening by photoirradiation, the unsaturated acid-modified epoxy resins are preferable. Examples of the unsaturated acids include maleic anhydride, tetrahydrophthalic anhydride, itaconic anhydride, acrylic acid, methacrylic acid, and the like. The resin is prepared by using an unsaturated carboxylic acid in an amount equivalent to or less than the amount of the epoxy groups in the epoxy resin. In addition, use of a thermosetting material such as melamine resin or cyanate ester resin or combined use thereof with a phenol resin is also preferable. It is possible to harden the adhesive present in the area behind intersections where no light is irradiated by addition of such a thermo-hardenable material.

In addition, a natural or synthetic rubber described above such as acrylonitrile-butadiene rubber, acrylic rubber, SBR, carboxylic acid-modified acrylonitrile-butadiene rubber, carboxylic acid-modified acrylic rubber, crosslinked NBR particles, carboxylic acid-modified or crosslinked NBR particles may be added for improvement in flexibility.

By adding various resin components above, it is possible to provide the hardened product with various properties while preserving its basic properties such as favorable photohardening and thermosetting efficiency. For example, it is possible to provide the hardened product with favorable electric insulating property by combined use of an epoxy resin and a phenol resin. Addition of a rubber component makes the hardened product tougher and makes it simpler to roughen the surface of the hardened product by surface treatment with an oxidative chemical solution.

Other additives normally used (polymerization stabilizer, leveling agent, pigment, dye, etc.) may be added additionally. A filler may also be added. Examples of the fillers include inorganic fine particles such as of silica, fused silica, talc, alumina, hydrated alumina, barium sulfate, calcium hydroxide, Aerojil, and calcium carbonate; organic fine particles such as powdery epoxy resin and powdery polyimide particles, and powdery polytetrafluoroethylene particles; and the like. These fillers may be treated with a coupling agent previously. Specific photosensitive adhesives include photobia film BF-8000 (trade name) manufactured by Hitachi Chemical Co., Ltd., and the like.

In addition to the method above of placing hollow filaments on a fixing layer 2 (in such a case, the hollow filaments may be embedded in the fixing layer), the method of placing the hollow filaments 5 on the supporting materials 1*a* and 1*b* include the following methods: a method of fusing hollow filaments on a supporting film (method of fixing hollow filaments on a supporting material by fusing at least part thereof, and part of the hollow filaments may be embedded in the supporting film); a method of placing hollow filaments on a supporting material or a fixing layer with an adhesive; a method of forming a dent pattern at positions of the supporting material where hollow filaments are placed for example by etching or plating and placing hollow filaments therein; a method of forming a dent pattern at positions of the fixing layer of the supporting material where hollow filaments are formed for example by etching, plating or photopatterning and placing hollow filaments therein; and the like. The hollow filaments are preferably fixed to a substantial degree that they give no adverse effect in the pretreatment processor in the subsequent analysis and measurement step. At least part of it is preferably fixed for improvement in reliability. Thus, the hollow filaments become more rigid structurally and can be used in applications in stricter environment.

The specific method of placing the hollow filaments is not particularly limited, and, for example, a commercially available apparatus may be used. Specific examples thereof include the method described in Japanese Patent Application Publication No. 50-9346 of using an apparatus placing hollow conductor filaments under load and ultrasonic wave vibration, the method described in Japanese Patent Application Publication No. 7-95622 of using an apparatus placing hollow filaments under load and irradiation of laser beam, and the like. Other examples include the method described in Japanese Patent Publication Laid-Open 2001-59910 of using an automatic optical fiber-wiring apparatus and the like. The method of forming a protective layer for prevention of exposure of the hollow filaments may be a method of laminating the fixing layer described above additionally as needed. A protective layer may be formed for further improvement in handling efficiency, even when the hollow filaments are structurally embedded in the supporting material or the fixing layer.

The material, structure, shape, position, and others of the inlet port 3 for external injection of fluid into the hollow filament and/or those of the outlet port 4 for external discharge are arbitrary. Use of a SUS or plastic fluid joint is particularly favorable. A single-core or multi-core hollow filament may be used, according to applications. It is also possible to make a higher-performance analytical pretreatment device by installing a joint having a valve or filter function. At least part of the inlet ports 3 and/or the outlet ports 4 are preferably fixed to the supporting material, for improvement in structural rigidity and for use in applications in stricter environment.

Any one of common commercially available cartridges containing a filler, for example for adsorption-desorption, ion exchange, separation, removal or distribution, may be used as the filler cartridge 6. The shape and size of the cartridge are also arbitrary.

The filler cartridge 6 may be integrated with the outlet port 4. The filler cartridge may be integrated with part of the outlet port for example with an adhesion, or alternatively, it is possible to make part of the outlet port have a function as a filler cartridge by filling a filler therein. Such integration leads to reduction in the number of parts used and also in cost.

In another embodiment, it is possible to form a simple valve, for example, by forming a through-hole in part of the analytical pretreatment device and deforming the hollow filament at the position while applying pressure on part of the hollow filament 5 for example with a cam motor.

EXAMPLES

FIG. 1 is a schematic top view illustrating the analytical pretreatment device in Example of the present invention. Shown in the Example is an analytical pretreatment device in which three kinds of analyte substances are contained in one sample and four kinds of fluids (1) a solvent for wetting the filler (buffer solution), (2) a sample solution, (3) washing water, and, (4) an elution solution are needed for pretreatment. The device has four inlet ports 3 Ai (i=1, 2, 3, and 4) 3-1, 3-2, 3-3, and 3-4; three outlet ports 4 Bj (j=1, 2, and 3) 4-1, 4-2, and 4-3; three filler cartridges 6 Cj (j=1, 2, and 3) 6-1, 6-2, and 6-3; twelve hollow filaments 5 connecting the inlet ports Aj to the outlet ports Bj, Xij (i=1, 2, 3, and 4, and j=1, 2, and 3) 5-11, 5-12, 5-13, 5-21, 5-22, 5-23, 5-31, 5-32, 5-33, 5-41, 5-42, and 5-43. In such a case, three kinds of fillers respectively suitable for the analyte substances are packed in the three filler cartridges. These inlet ports 3 and outlet ports 4 are connected to the supporting material 1, and the filler cartridges 6 are connected to the outlet ports 4.

An aramide film Mictron (registered trade name, thickness: 12 μm) manufactured by Toray Industries Inc. was sued as the first supporting material, one of the supporting materials 1. A nontacky silicone adhesive DK-9009 film manufactured by Dow Corning Asia (thickness 50 μm) was laminated on the supporting material at room temperature (25° C.) as the fixing layer 2; a high-performance engineering plastic tube manufactured by Nirei Industry Co., Ltd. (material: PEEK, internal diameter: 0.2 mm, external diameter: 0.4 mm) was placed temporarily on the fixing layer as the hollow filament 5; and then, a transparent silicone rubber SYLGARD184 manufactured by Dow Corning Asia was coated as the second supporting material and pressed under sufficient load. An NC wiring machine having a numerically controlled movable X-Y table allowing ultrasonic wave vibration and load output control was used in wiring. The plate was then processed along the desirable cutting line, by using a laser-drilling machine for drilling small-diameter holes in printed circuit boards.

Commercially available PEEK fluid joints were connected to both ends of the hollow filament 5 respectively as input ports 3 and output ports 4, and a commercially available cartridge for solid-phase extraction Sep-Pak PS-2 manufactured by Japan Waters was connected to the terminal of each outlet port 4 as the filler cartridge 6.

Although the present invention was described with the embodiments above, it should be construed that the present invention is not restricted by the range and the drawings in part of the disclosure. Various modifications of the embodiments, Examples and operational methods will be obvious for those who are skilled in the art from the disclosure above.

Industrial Applicability

The analytical pretreatment device according to the present invention allows automation of the processing in the analytical pretreatment step, improving accuracy and lowering fluctuation therein by operators. It also allows saving in labor. It is also possible to form long-distance channels in the order of cm to m, depending on specification, and thus, the analytical pretreatment device is easily applicable to large-scale analytical and measuring instrument. It can also cope with reduction in size of analytical and measuring instruments, by reduction in diameter of the hollow filament.

The invention claimed is:

1. An analytical pretreatment device, comprising a supporting material, m inlet ports as fluid injection ports, n outlet ports as fluid outlet port, hollow filaments that do not leak fluid communicating between the inlet ports and the outlet ports, wherein the number of hollow filaments is equal to the equation m×n, and a plurality of filler cartridges, wherein each of the n outlet ports are connected to a respective filler cartridge, wherein, m is a natural number of two or more; and n is a natural number of two or more, wherein the n filler cartridges are located after the n outlet ports, respectively, wherein at least one hollow filament is placed in such a manner that it crosses at least one other hollow filament, wherein the supporting material comprises a first supporting material and a second supporting material, wherein the hollow filaments are placed longitudinally between the first supporting material and the second supporting material, and further comprising a fixing layer formed on the hollow filament-sided surface of at least one of the first supporting material and the second supporting material for holding the hollow filaments.

2. The analytical pretreatment device according to claim 1, wherein at least part of the inlet ports are connected to the supporting material.

3. The analytical pretreatment device according to claim 1, wherein at least part of the outlet ports are connected to the supporting material.

4. The analytical pretreatment device according to claim 1, wherein at least part of the hollow filaments are connected to the supporting material.

5. The analytical pretreatment device according to claim 1, wherein the outlet ports and respective filler cartridges are integrated.

6. The analytical pretreatment device according to claim 1, wherein the supporting material is a supporting film.

7. The analytical pretreatment device according to claim 1, wherein the internal diameter of the hollow filaments is 0.01 to 1.0 mm.

8. The analytical pretreatment device according to claim 1, wherein the thickness of the supporting material is 0.05 mm or more.

9. The analytical pretreatment device according to claim 1, wherein the upper limit of the thickness of the supporting material is 3 mm.

10. The analytical pretreatment device according to claim 1, wherein the thickness of the supporting material is 0.5 mm or more.

11. The analytical pretreatment device according to claim 1, wherein at least part of the hollow filaments are connected to the supporting material and wherein the outlet ports and respective filler cartridges are integrated.

12. An analytical pretreatment device, comprising a supporting material, m inlet ports as fluid injection ports, n outlet ports as fluid outlet port, hollow filaments that do not leak fluid communicating between the inlet ports and the outlet ports, wherein the number of hollow filaments is equal to the equation m×n, and a plurality of filler cartridges, wherein each of the n outlet ports are connected to a respective filler cartridge, wherein m is a natural number of two or more; and n is a natural number of two or more, wherein the n filler cartridges are located after the n outlet ports, respectively, wherein at least one hollow filament is placed in such a manner that it crosses at least one other hollow filament, wherein the supporting material comprises a first supporting material and a second supporting material, wherein the hollow filaments are placed longitudinally between the first supporting material and the second supporting material, and further comprising a fixing layer formed on the hollow filament-sided surface of at least one of the first supporting material and the second supporting material for holding the hollow filaments, wherein the fixing layer is a layer of at least one of an adhesive, adhesive material, rubber and gel.

13. The analytical pretreatment device according to claim 12, wherein at least part of the inlet ports are connected to the supporting material.

14. The analytical pretreatment device according to claim 12, wherein at least part of the outlet ports are connected to the supporting material.

15. The analytical pretreatment device according to claim 12, wherein at least part of the hollow filaments are connected to the supporting material.

16. The analytical pretreatment device according to claim 12, wherein the outlet ports and respective filler cartridges are integrated.

17. The analytical pretreatment device according to claim 12, wherein the internal diameter of the hollow filaments is 0.01 to 1.0 mm.

18. The analytical pretreatment device according to claim 12, wherein the thickness of the supporting material is 0.05 mm or more.

19. The analytical pretreatment device according to claim 12, wherein the upper limit of the thickness of the supporting material is 3 mm.

20. The analytical pretreatment device according to claim 12, wherein the thickness of the supporting material is 0.5 mm or more.

21. An analytical pretreatment device, comprising a supporting material, m inlet ports as fluid injection ports, n outlet ports as fluid outlet port, hollow filaments that do not leak fluid communicating between the inlet ports and the outlet ports, wherein the number of hollow filaments is equal to the equation m×n, and a plurality of filler cartridges, wherein each of the n outlet ports are connected to a respective filler cartridge, wherein m is a natural number of two or more; and n is a natural number of two or more, wherein the n filler cartridges are located after the n outlet ports, respectively, wherein at least one hollow filament is placed in such a manner that it crosses at least one other hollow filament, wherein the supporting material comprises a first supporting material and a second supporting material, wherein the hollow filaments are placed longitudinally between the first supporting material and the second supporting material, and wherein the outlet ports and respective filler cartridges are integrated.

22. The analytical pretreatment device according to claim 21, wherein at least part of the inlet ports are connecting to the supporting material.

23. The analytical pretreatment device according to claim 21, wherein at least part of the outlet ports are connected to the supporting material.

24. The analytical pretreatment device according to claim 21, wherein at least part of the hollow filaments are connected to the supporting material.

25. The analytical pretreatment device according to claim 21, wherein the supporting material has a fixing layer for holding the hollow filaments.

26. The analytical pretreatment device according to claim 21, wherein part of the outlet ports have function as a filler cartridge by filling a filler therein.

27. The analytical pretreatment device according to claim 21, wherein the internal diameter of the hollow filaments is 0.01 to 1.0 mm.

28. The analytical pretreatment device according to claim 21, wherein the thickness of the supporting material is 0.05 mm or more.

29. The analytical pretreatment device according to claim 21, wherein the upper limit of the thickness of the supporting material is 3 mm.

30. The analytical pretreatment device according to claim 21, wherein the thickness of the supporting material is 0.5 mm or more.

31. An analytical pretreatment device, comprising a supporting material, m inlet ports as fluid injection ports, n outlet ports as fluid outlet ports, hollow filaments that do not leak fluid communicating between the inlet ports and the outlet ports, wherein the number of hollow filaments is equal to the equation m×n, and a plurality of filler cartridges, wherein each of the n outlet ports are connected to a respective filler cartridge, wherein m is a natural number of two or more; and n is a natural number of two or more, and wherein the n filler cartridges are located after the n outlet ports, respectively wherein the supporting material comprises a first supporting material and a second supporting material, and wherein the hollow filaments are placed longitudinally between the first supporting material and the second supporting material.

* * * * *